US006164643A

United States Patent [19]

Otsuka

[11] Patent Number: 6,164,643

[45] Date of Patent: Dec. 26, 2000

[54] LATERAL PAPER POSITION CORRECTING MECHANISM

[75] Inventor: Masao Otsuka, Osaka, Japan

[73] Assignee: Kyocera Mita Corporation, Osaka, Japan

[21] Appl. No.: 09/143,191

[22] Filed: Aug. 31, 1998

[30] Foreign Application Priority Data

| | | | |
|---|---|---|---|
| Sep. 2, 1997 | [JP] | Japan | 9-237520 |
| Sep. 2, 1997 | [JP] | Japan | 9-237521 |
| Sep. 2, 1997 | [JP] | Japan | 9-237524 |

[51] Int. Cl.[7] ..... B65H 9/16; B65H 7/02

[52] U.S. Cl. ..... 271/250; 271/228; 271/251

[58] Field of Search ..... 271/228, 250, 271/251

[56] References Cited

U.S. PATENT DOCUMENTS

| | | | |
|---|---|---|---|
| 4,257,587 | 3/1981 | Smith | 271/251 |
| 4,426,073 | 1/1984 | Mizuma | 271/251 |
| 4,676,498 | 6/1987 | Kanemitsu et al. | 271/251 |
| 4,809,968 | 3/1989 | Malachowski | 271/251 |
| 4,971,309 | 11/1990 | Reid-Green | 271/251 |
| 4,995,504 | 2/1991 | Kuhn | 271/251 |
| 5,048,817 | 9/1991 | Roller | 271/250 |
| 5,065,998 | 11/1991 | Salomon | 271/251 |
| 5,162,857 | 11/1992 | Higeta et al. | 271/251 |
| 5,381,021 | 1/1995 | Polidoro | 271/251 |
| 5,601,283 | 2/1997 | Pinckney | 271/228 |
| 5,697,609 | 12/1997 | Williams et al. | 271/228 |

*Primary Examiner*—Donald P. Walsh
*Assistant Examiner*—Brett C. Martin
*Attorney, Agent, or Firm*—Jordan and Hamburg LLP

[57] ABSTRACT

A paper path is provided with a paper guide for guiding paper, an oblique roller for obliquely moving the paper toward the paper guide and an electromagnetic clutch allowing and interrupting transmission of a rotating force to the oblique roller. Sensors for detecting the paper are provided upstream and downstream of the oblique roller. Also provided in the paper path is a controller which controls the electromagnetic clutch in accordance with paper sensing operation of the sensors to drive the oblique roller while the paper is passing under the oblique roller. A low-friction paper guiding surface is formed on the paper guide by coating it with a fluoroplastic.

21 Claims, 11 Drawing Sheets

LATERAL PAPER POSITION CORRECTING MECHANISM

BACKGROUND OF THE INVENTION AND RELATED ART STATEMENT

The present invention relates to a lateral paper position correcting mechanism for use in an image forming apparatus such as a copying machine or a printer.

One known example of a conventional lateral paper position correcting mechanism is disclosed in Japanese Unexamined Patent Publication No. 7-89645. In this lateral paper position correcting mechanism, a side guide is fitted along a paper path and an oblique roller is provided beside the side guide. As the oblique roller obliquely transfers paper being fed, a side edge of the paper comes into contact with the side guide, whereby the position of the paper in the paper path is corrected in the paper's lateral direction, or in the direction perpendicular to the paper feeding direction.

In this mechanism, the oblique roller is made movable between a driving position where the oblique roller comes into contact with the paper and a retracted position where the oblique roller is separated from the paper, and a pair of transfer rollers provided immediately upstream of the oblique roller can be switched between a pressing state in which the transfer roller pair nips the paper and a non-pressing state. In paper feeding operation, the transfer rollers are set to the pressing state and feed the paper, and when a sensor senses that the leading edge of the paper has reached the location of the oblique roller, the oblique roller is set to its driving position and the transfer roller pair is set to its non-pressing state. When completion of the correction of the paper position is sensed, the oblique roller is returned to its retracted position and the transfer roller pair is set to its pressing state so that the paper is transferred downstream by the transfer roller pair thereafter.

Since the oblique roller is made movable between the driving position and the retracted position and it is returned to the retracted position upon completion of paper position correction in the aforementioned conventional lateral paper position correcting mechanism, it is possible to prevent an excessive obliquely pushing force from acting on the paper after the completion of the paper position correcting operation. Thus, this mechanism is advantageous in that the paper is less likely to be bent although it is forced in an oblique direction and brought into contact with the side guide.

There exists a potential for the once corrected paper to deviate in its lateral direction, however, because the oblique roller is moved to its retracted position immediately after the completion of the paper position correcting operation. It is therefore impossible for the aforementioned conventional mechanism to properly perform the paper position correcting operation.

The aforementioned mechanism has another drawback in that it is apt to develop a paper feeding problem since the paper is advanced only by the transfer roller pair located on the upstream side of the oblique roller after the paper position correcting operation. More specifically, there exists a frictional resistance between the side guide and the paper after the paper position correcting operation because the latter is transferred in contact with the former. Since the transfer rollers nip a rear portion of the paper (a portion closer to the trailing edge of the paper) when transferring the paper after the paper position correcting operation, a forward portion of the paper tends to jam or otherwise become stuck in the paper path due to the frictional resistance or the slope of the paper path. Thus, the mechanism needs to be improved to ensure smooth paper feeding after the paper position correcting operation.

SUMMARY OF THE INVENTION

This invention is intended to provide a solution to the aforementioned problems of prior art technology. Accordingly, it is an object of the invention is to provide a lateral paper position correcting mechanism which can properly correct the position of paper in a paper path in its lateral direction without causing the paper to bend and thereby ensure smooth paper feeding.

To accomplish this object, a lateral paper position correcting mechanism of the invention comprises a paper aligning member mounted in a paper path parallel to a paper feeding direction; an oblique roller for moving paper at an oblique angle to the paper feeding direction to cause the paper to come into contact with said paper aligning member to correct the position of the paper in said paper path in its lateral direction; a paper sensor capable of detecting the paper at least while the paper is passing by said oblique roller; a driving controller which drives said oblique roller while the paper is being detected by said paper sensor; and preventing means for preventing the paper from bending while it is being transferred.

Since the oblique roller continues to be rotated until the paper completely passes by the oblique roller, it is possible to apply an obliquely pushing force to the paper even after the paper has come into contact with the paper aligning member, or even after the completion of paper position correcting operation, in the lateral paper position correcting mechanism of the invention. The paper is therefore kept in contact with the paper aligning member even after the completion of paper position correcting operation. Since the oblique roller continues to be driven even after the paper position correcting operation, it is possible to exert the obliquely pushing force on the paper, especially on a more forward portion of the paper compared to the conventional mechanism in which the oblique roller is withdrawn to its retracted position after the paper position correcting operation and the paper is then advanced only by a pair of transfer rollers located upstream of the oblique roller. Thus, the lateral paper position correcting mechanism of the invention ensures smooth paper feeding without causing the paper to jam or otherwise become stuck in the paper path. Moreover, the paper is not bent even when the oblique roller continues to be driven after the paper position correcting operation because the mechanism is provided with the preventing means for preventing the paper being transferred from bending.

DETAILED DESCRIPTION OF THE PREFERRED EMBODIMENTS OF THE INVENTION

A first embodiment of the invention is now described with reference to FIGS. 1 and 2.

Figure 1:
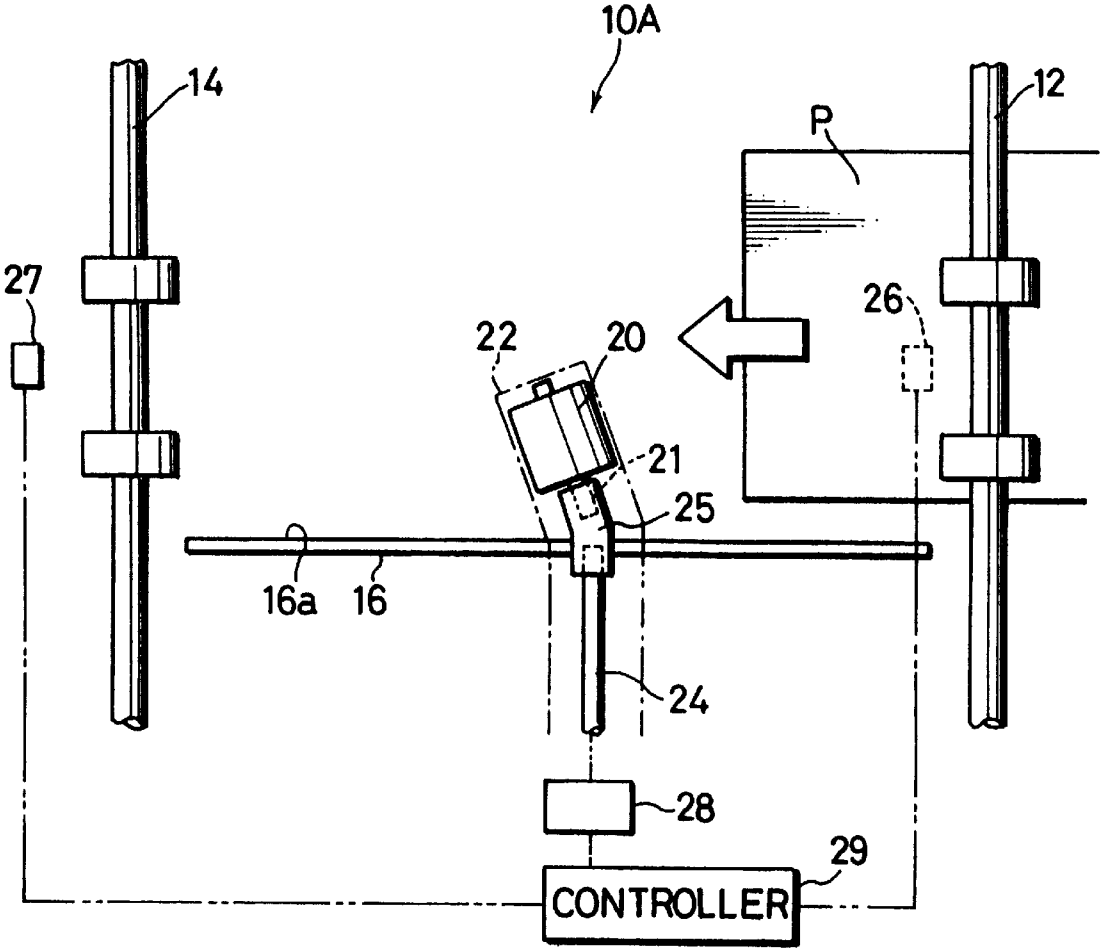
FIG. 1 is a plan view showing a paper path of a copying machine incorporating a lateral paper position correcting mechanism according to a first embodiment of the invention.
Figure 2:
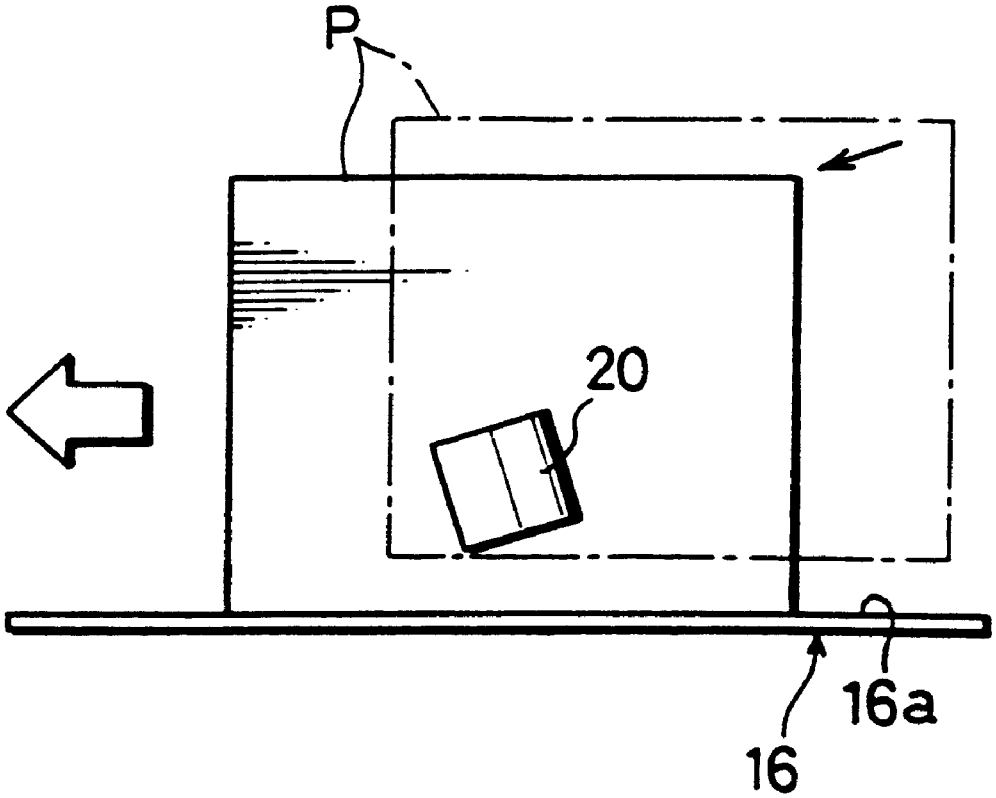
FIG. 2 is a schematic diagram illustrating how the lateral position of paper is corrected.

FIG. 1 shows a paper path 10A of a copying machine incorporating a lateral paper position correcting mechanism of the first embodiment and, more particularly, FIG. 1 shows part of the paper path 10A immediately upstream of a pair of registration rollers which aligns the leading edge of paper P.

The paper path 10A shown in FIG. 1 is provided with a pair of transfer rollers 12 located at an upstream side (right side in FIG. 1), a pair of transfer rollers 14 located at a downstream side (left side in FIG. 1), a paper guide 16 extending between the transfer roller pairs 12 and 14 as well as an oblique roller 20 located at a position closer to the center of the paper path 10A than the paper guide 16 for transferring the paper P toward the paper guide 16.

The oblique roller 20 is supported by a mounting member 22 which is affixed to a frame of the copying machine in such a way that the oblique roller 20 comes into contact with the paper P. A rotary shaft 21 of the oblique roller 20 is connected to a drive shaft 24 through a universal joint 25 as shown in FIG. 1. The drive shaft 24 is linked to an unillustrated driving motor via an electromagnetic clutch 28 and an unillustrated torque transmitter formed of gears and other elements so that the oblique roller 20 rotates when a rotating force is transmitted from the driving motor.

The paper guide 16 is located on a paper feeding plane of the paper path 10A close to its side edge (lower edge in FIG. 1) along a paper feeding direction, and a guiding surface 16*a* parallel to the paper feeding direction is formed on one side (upper side in FIG. 1) of the paper guide 16 facing the center line of the paper path 10A.

The guiding surface 16*a* is formed by coating a raw surface of the paper guide 16 with a fluoroplastic to permit the paper P to be transferred extremely smoothly in the paper feeding direction when a side edge of the paper P comes into contact with the guiding surface 16*a*.

Designated by the numerals 26 and 27 in FIG. 1 are sensors for detecting the paper P that are embedded in the paper feeding plane downstream of the transfer roller pairs 12 and 14, respectively. These paper sensors 26, 27 are reflection-type sensing devices which sense the paper P by detecting light reflected by the paper P, for instance. In particular, the sensor 27 is disposed such that it senses the leading edge of the paper P when the trailing edge of the paper P has completely passed under the oblique roller 20.

Although not specifically illustrated, the copying machine is provided with a controller 29 which is electrically connected to the electromagnetic clutch 28 and the sensors 26, 27 for controlling overall operation of the copying machine. When the copying machine is being operated, the oblique roller 20 is operated in synchronism with paper sensing operation of the sensors 26, 27 as will be described later.

In the aforementioned construction, the paper P is fed in the direction of an arrow shown in FIG. 1. The rotating force is not transmitted to the oblique roller 20 until the paper P reaches the sensor 26. When the paper P proceeds beyond the transfer roller pair 12 and its leading edge is detected by the sensor 26, the electromagnetic clutch 28 is engaged and the rotating force of the driving motor is transmitted to the oblique roller 20.

When the paper P is further advanced and its leading edge reaches the oblique roller 20, the paper P is transferred by both the transfer roller pair 12 and the oblique roller 20 and an obliquely pushing force of the oblique roller 20 is exerted on the paper P, causing it to be transferred obliquely toward the paper guide 16. As a result, a side edge of the paper P gradually comes into contact with the guiding surface 16*a* of the paper guide 16 from the forward part of the paper edge and eventually aligns with the guiding surface 16*a*, whereby the position of the paper P in the paper path 10A in its lateral direction is corrected as shown in FIG. 2.

When the paper P further transferred goes beyond the transfer roller pair 14 and its leading edge is detected by the sensor 27, that is, when the paper P has completely passed under the oblique roller 20, the electromagnetic clutch 28 is disengaged and transmission of the rotating force to the oblique roller 20 is interrupted so that the paper P is advanced downstream only by the transfer roller pair 14 thereafter.

According to the above-described construction, the oblique roller 20 is driven until the paper P completely passes under the oblique roller 20 regardless of whether the paper position correcting operation has been completed. Therefore, the oblique roller 20 continuously exerts the obliquely pushing force on the paper P so that the paper P is transferred with its side edge held in full contact with the guiding surface 16*a*, that is, the lateral position of the paper P after the paper position correcting operation is maintained as it is transferred downstream along the paper path 10A.

There is not a potential for the once corrected paper P to deviate in its lateral direction unlike the conventional mechanism in which the oblique roller is withdrawn to its retracted position immediately after the paper position correcting operation. Thus, the paper P is correctly positioned in its lateral direction in the paper path 10A in a reliable manner.

Furthermore, since the paper P is transferred by a combination of the transfer roller pair 12 and the oblique roller 20, which is located downstream of the transfer roller pair 12, until the paper P completely passes under the transfer roller pair 12, it is possible to exert a greater feeding force on the paper P, especially on a more forward portion of the paper P, compared to the conventional mechanism in which the oblique roller is withdrawn to its retracted position immediately after the paper position correcting operation and the paper is then advanced only by a pair of transfer rollers located upstream of the oblique roller. Thus, the lateral paper position correcting mechanism of this embodiment ensures smooth paper feeding after the paper position correcting operation without causing the forward portion of the paper P to jam or otherwise become stuck in the paper path 10A.

Moreover, the paper P slides along the guiding surface 16*a* extremely smoothly since the guiding surface 16*a* is coated with the fluoroplastic as mentioned earlier. It is therefore possible to effectively prevent bending of the paper P although the obliquely pushing force exerted on the paper P is maintained even after the paper position correcting operation. The reason why the paper tends to be bent if the obliquely pushing force exerted on the paper P is maintained after the paper position correcting operation in the conventional lateral paper position correcting mechanism is that a considerable frictional resistance occurs between the paper and a guiding surface. In the aforementioned construction employing the guiding surface 16*a* coated with the fluoroplastic, the frictional resistance exerted on the paper P due to sliding contact between the paper P and the guiding surface 16*a* is extremely small and the paper P is less likely to be bent even when the oblique roller 20 continues to be driven after the paper position correcting operation.

It would be appreciated from the foregoing discussion that the lateral paper position correcting mechanism of this embodiment corrects the lateral position of the paper P in a reliable manner and ensures smooth paper feeding without causing paper feeding problems.

Although the fluoroplastic is used for forming a low-friction sliding surface on the paper guide 16 in the above-described construction, the guiding surface 16*a* may be formed by coating it with other low-friction material such as polyethylene, for example. In another alternative, the paper guide 16 itself may be made of a low-friction material instead of coating it with a low-friction material.

A second embodiment of the invention is now described with reference to FIG. 3.

Figure 3:
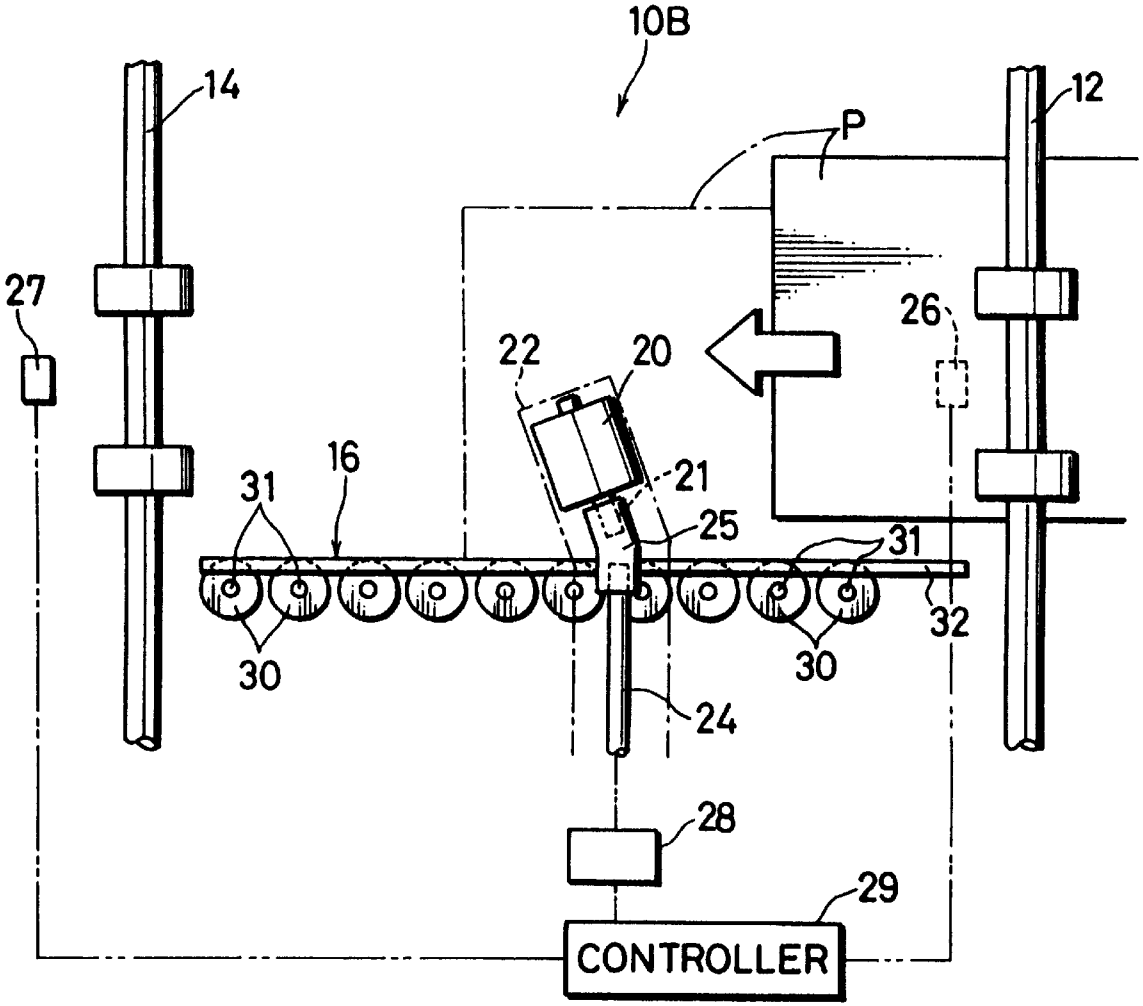
FIG. 3 is a plan view showing a paper path of a copying machine incorporating a lateral paper position correcting mechanism according to a second embodiment of the invention.

FIG. 3 shows a paper path 10B incorporating a lateral paper position correcting mechanism of the second embodiment. The following discussion of this embodiment focuses on differences from the paper path 10A of the first embodiment, in which elements identical to or equivalent to those included in the paper path 10A are designated by the same reference numerals.

In the paper path 10B shown in FIG. 3, a paper guide 16 is constructed of a plurality of rollers 30 aligned along the feeding direction of paper P. The rollers 30 are arranged in such a way that an imaginary plane with which curved outer surfaces of the rollers 30 come into contact is in parallel to the paper feeding direction. The individual rollers 30 are rotatably supported by bearings which are mounted on supporting shafts 31 fitted at right angles to a paper feeding plane of the paper path 10B. With this arrangement, the lateral position of the paper P is corrected when the paper P comes into contact with the curved outer surfaces of the rollers 30. Designated by the numeral 32 in FIG. 3 is a protective plate fitted on the paper path 10B. Although not specifically illustrated, the outer surfaces of the rollers 30 are partially exposed to a paper transport side through cutouts formed in the protective plate 32.

In this construction, the paper position correcting operation is performed by bringing the paper P into contact with the rollers 30 as described above. Since the rollers 30 smoothly rotate in the paper feeding direction when the paper P comes into contact with the rollers 30, resistance to the paper feeding force acting on the paper P as a result of contact between the paper P and the rollers 30 is extremely small and the paper P is less likely to be bent even when the oblique roller 20 continues to be driven after the paper position correcting operation. Accordingly, this construction can properly correct the lateral position of the paper P as well while transferring the paper P smoothly in a manner similar to the first embodiment.

A third embodiment of the invention is now described with reference to FIG. 4.

Figure 4:
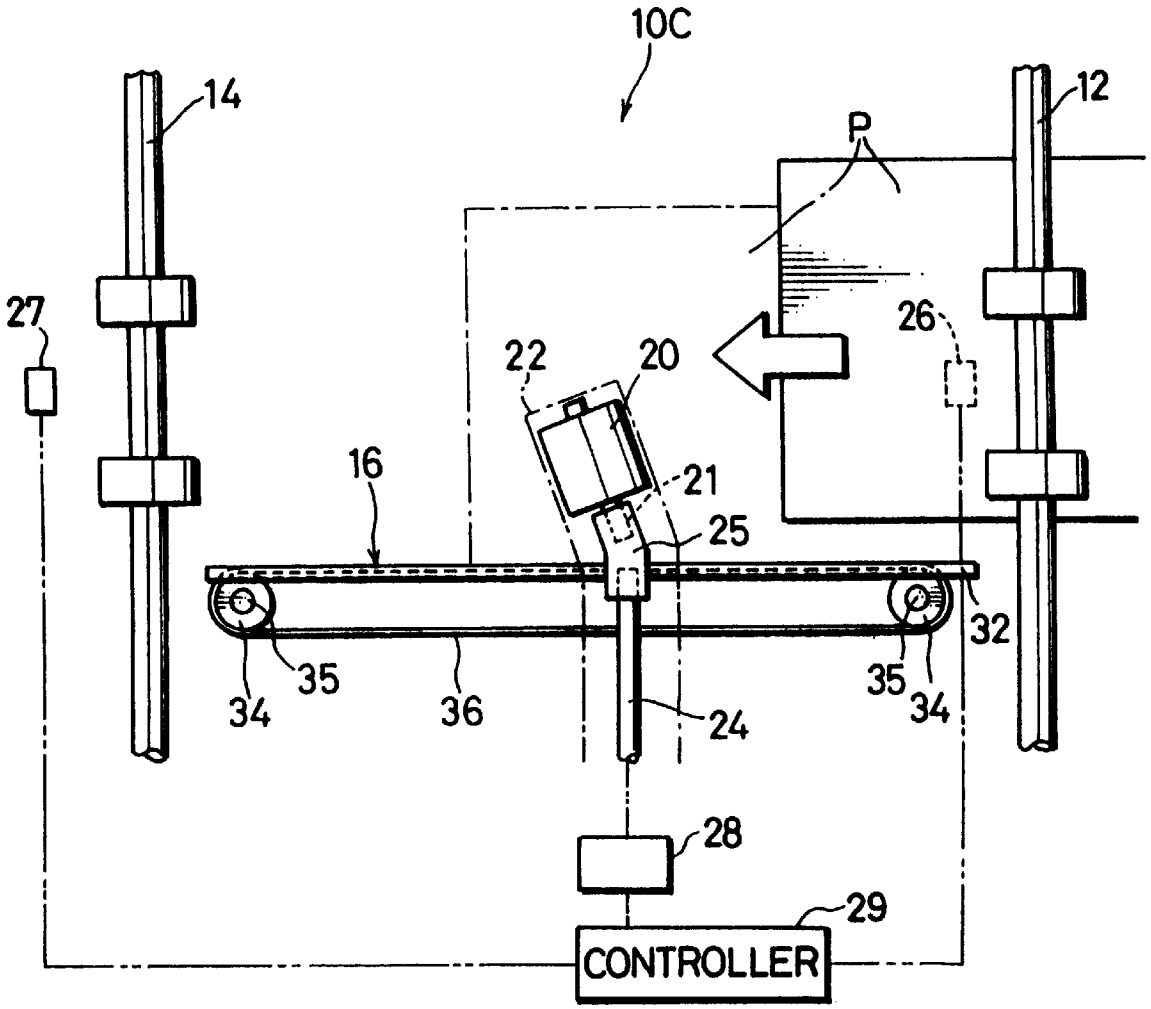
FIG. 4 is a plan view showing a paper path of a copying machine incorporating a lateral paper position correcting mechanism according to a third embodiment of the invention.

FIG. 4 shows a paper path 10C incorporating a lateral paper position correcting mechanism of the third embodiment. The following discussion of this embodiment focuses on differences from the paper path 10A of the first embodiment, in which elements identical to or equivalent to those included in the paper path 10A are designated by the same reference numerals.

In the paper path 10C shown in FIG. 4, a paper guide 16 is constructed of an endless belt 36 mounted around a pair of pulleys 34 which are separated in the feeding direction of paper P. The individual pulleys 34 are rotatably supported by bearings which are mounted on supporting shafts 35 fitted at right angles to a paper feeding plane of the paper path 10C. An outer surface of the belt 36 mounted around the pulleys 34 is made parallel to the paper feeding direction and exposed to a paper transport side through a cutout formed in a protective plate 32.

In this construction, the paper position correcting operation is performed by bringing the paper P into contact with the outer surface of the belt 36. Since the belt 36 smoothly rotates in the paper feeding direction when the paper P comes into contact with the belt 36, resistance to the paper feeding force acting on the paper P as a result of contact between the paper P and the paper guide 16 is so small that the paper P is less likely to be bent even when the oblique roller 20 continues to be driven after the paper position correcting operation. It is therefore possible to produce effects similar to the first embodiment.

A fourth embodiment of the invention is now described with reference to FIG. 5.

Figure 5:
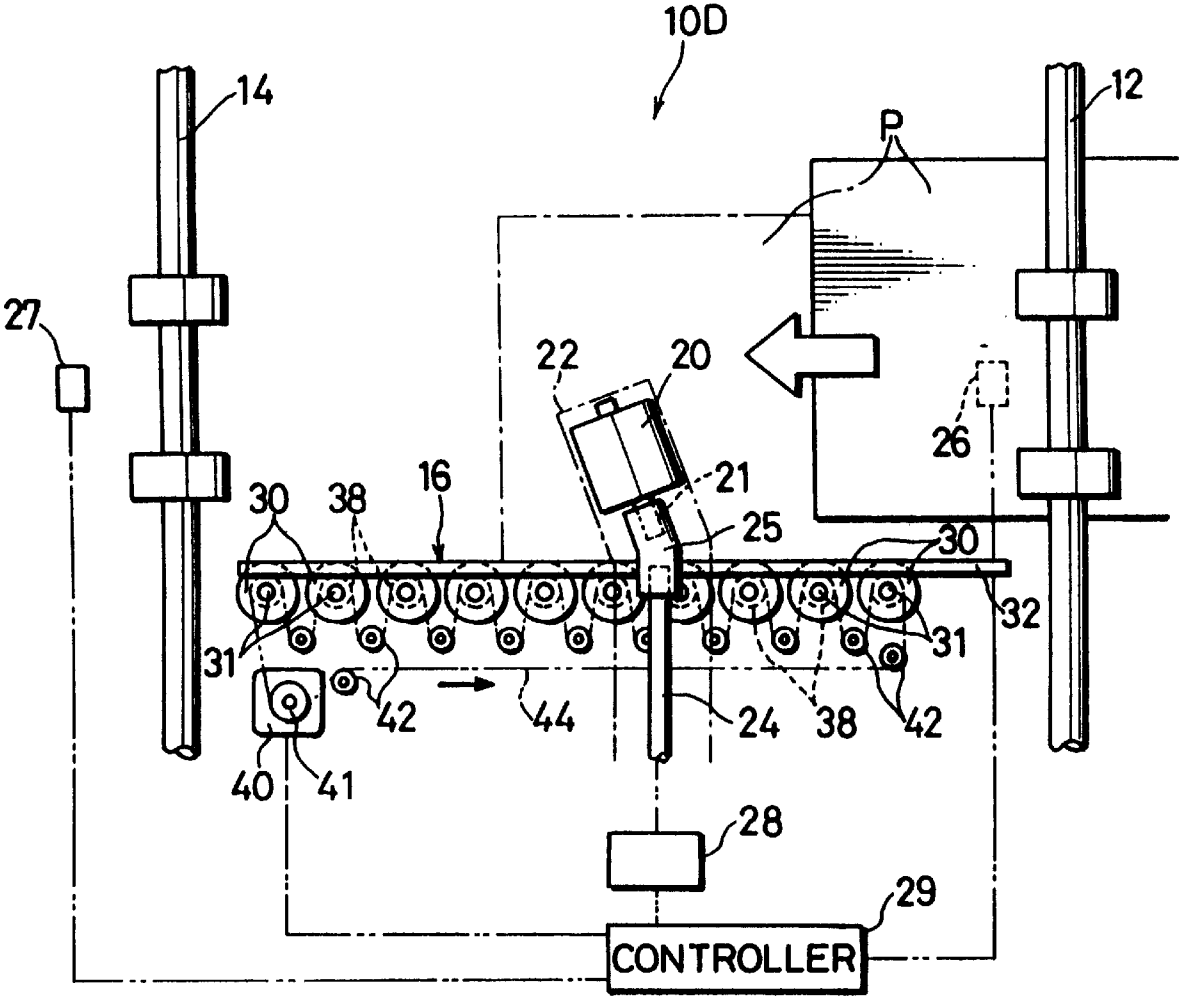
FIG. 5 is a plan view showing a paper path of a copying machine incorporating a lateral paper position correcting mechanism according to a fourth embodiment of the invention.

FIG. 5 shows a paper path 10D incorporating a lateral paper position correcting mechanism of the fourth embodiment. The paper path 10D of FIG. 5 differs from the paper path 10B of FIG. 3 in that individual rollers 30 are forced to rotate.

More particularly, supporting shafts 31 are rotatably mounted on a frame of a copying machine with bearings fitted in between, and the rollers 30 are fixed on the individual supporting shafts 31 so that the rollers 30 rotate together with the supporting shafts 31. The individual supporting shafts 31 are also fitted with timing pulleys 38 which are associated with tension pulleys 42 mounted close to the supporting shafts 31. Further, a timing belt 44 is mounted on the timing pulleys 38, the tension pulleys 42 and a pulley 41 fitted on an output shaft of a motor 40. When the timing belt 44 is run by the motor 40, all the rollers 30 are caused to rotate in the same direction at the same speed. The motor 40 is controllably driven by a controller 29.

In this construction, the motor 40 is driven in synchronism with operating timing of the oblique roller 20. The rollers 30 are caused to rotate in such a way that they exert a feeding force on paper P when it comes into contact with the rollers 30. Specifically, the rollers 30 are rotated in the counter-clockwise direction as illustrated in FIG. 5.

According to the above-described construction, when the paper P is brought into contact with curved outer surfaces of the rollers 30 for performing paper position correction, the rollers 30 exert the paper feeding force on the paper P because the rollers 30 are rotated. Thus, the paper P is acted upon by a resultant, or a combination, of the paper feeding force exerted by the rollers 30 and the obliquely pushing force exerted by the oblique roller 20 after paper position correction, the resultant force being more parallel to the paper feeding direction. The obliquely pushing force acting on the paper P is therefore lessened upon completion of the paper position correcting operation, making it possible to effectively prevent the bending of the paper P.

It would be appreciated from the foregoing discussion that this construction can properly correct the lateral position of the paper P as well while transferring the paper P smoothly in a manner similar to the earlier-described paper paths 10A to 10C.

Since a large extension of a side edge of the paper P, ranging from its leading edge to trailing edge, is held in contact with the rollers 30 after the paper position correcting operation in this paper path 10D, it is possible to exert a greater feeding force on the paper P, especially on a more forward portion of the paper P, compared to the paper paths 10A to 10C. Thus, the lateral paper position correcting mechanism of this embodiment ensures smooth paper feeding after the paper position correcting operation without causing the forward portion of the paper P to jam or otherwise become stuck in the paper path 10D.

A fifth embodiment of the invention is now described with reference to FIG. 6.

Figure 6:
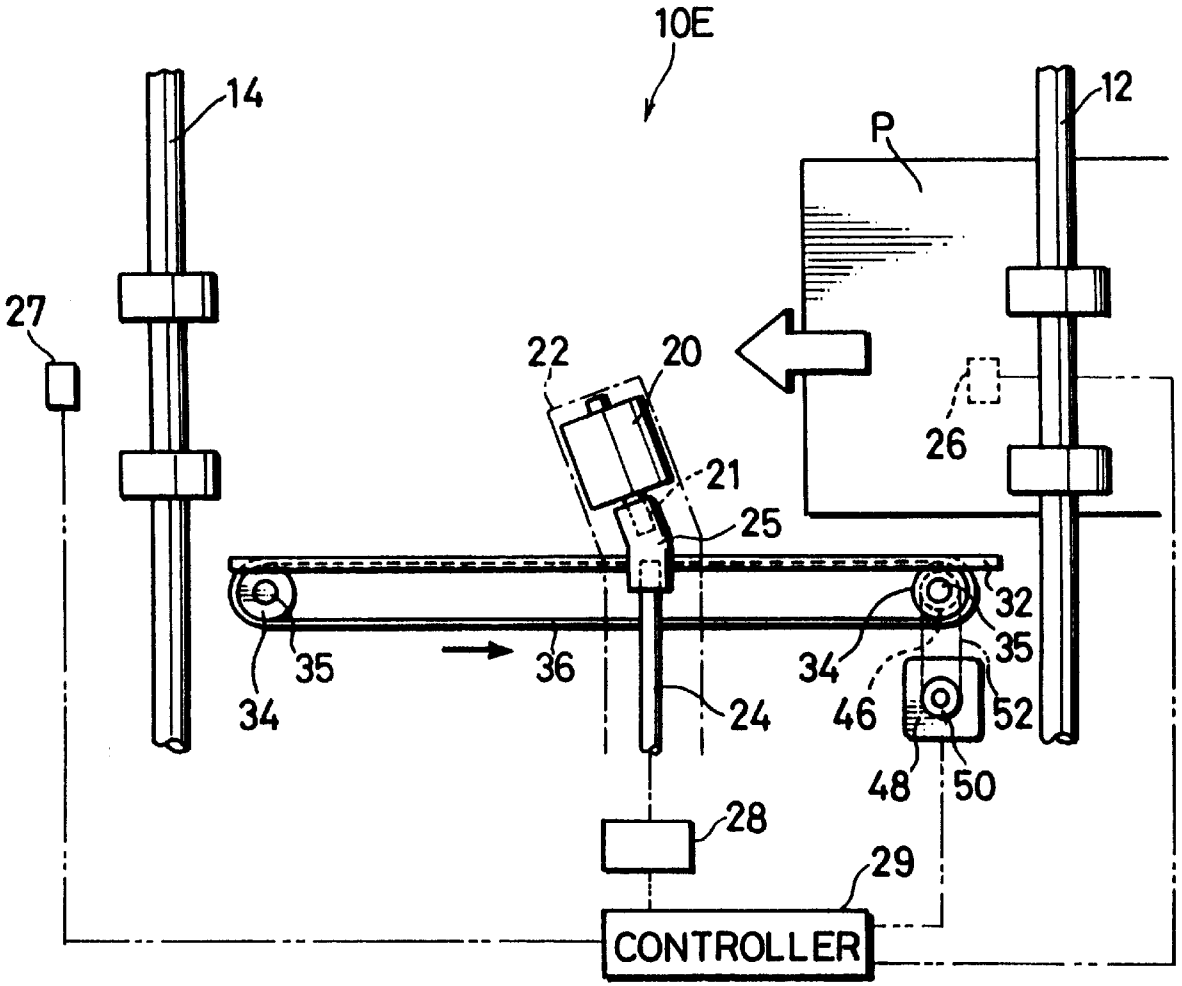
FIG. 6 is a plan view showing a paper path of a copying machine incorporating a lateral paper position correcting mechanism according to a fifth embodiment of the invention.

FIG. 6 shows a paper path 10E incorporating a lateral paper position correcting mechanism of the fifth embodiment. The paper path 10E of FIG. 6 differs from the paper path 10C of FIG. 4 in that a belt 36 is forced to rotate.

More particularly, a supporting shaft 35 on the upstream side (right side in FIG. 6) is rotatably mounted on a frame of a copying machine with a bearing fitted in between, and a pulley 34 is firmly fitted on the supporting shaft 35 so that the pulley 34 rotates together with the supporting shaft 35. Further, this supporting shaft 35 is fitted with a timing pulley 46, and a timing belt 52 is mounted around the timing pulley 46 and a pulley 50 fitted on an output shaft of a motor 48. When the motor 48 is driven, the belt 36 is caused to rotate in a specified direction at a constant speed. The motor 48 is controllably driven by a controller 29.

In this construction, the motor 48 is driven in synchronism with operating timing of the oblique roller 20 and the belt 36 is caused to turn in the counterclockwise direction as illustrated in FIG. 6. As a result, the belt 36 exerts a feeding force on paper P upon completion of paper position correction. Thus, the paper P is acted upon by a force which is more parallel to the paper feeding direction and this makes it possible to effectively prevent the bending of the paper P. It should now be appreciated that the paper path 10E thus constructed produces advantageous effects similar to the earlier-described paper paths 10A to 10D.

A sixth embodiment of the invention is now described with reference to FIGS. 7 to 10.

Figure 7:
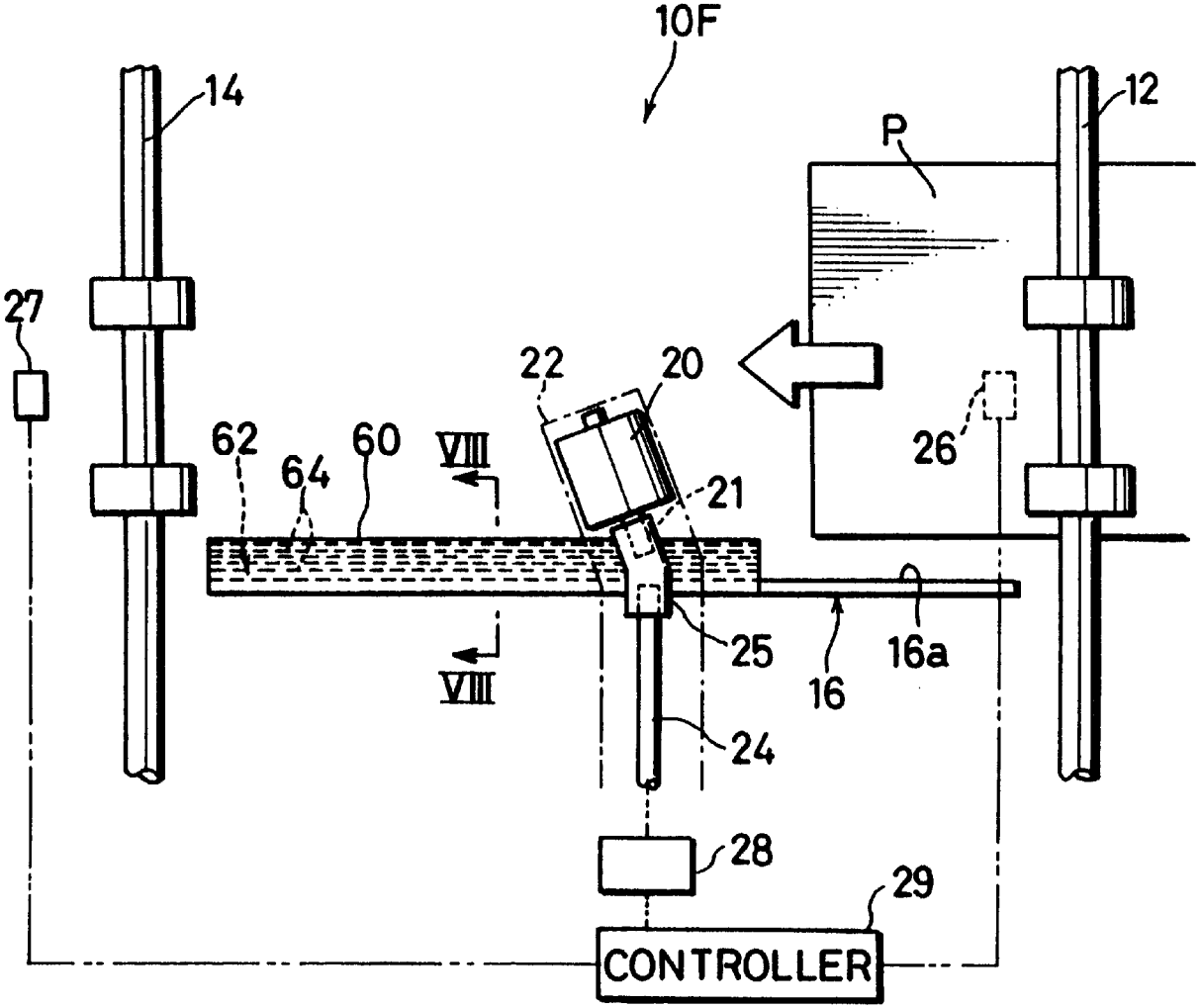
FIG. 7 is a plan view showing a paper path of a copying machine incorporating a lateral paper position correcting mechanism according to a sixth embodiment of the invention.

FIG. 7 shows a paper path 10F incorporating a lateral paper position correcting mechanism of the sixth embodiment. The following discussion of this embodiment focuses on differences from the paper path 10A of the first embodiment, in which elements identical to or equivalent to those included in the paper path 10A are designated by the same reference numerals.

In the paper path 10F shown in FIG. 7, there is provided a paper presser 62 facing a paper feeding plane 11 (shown in FIG. 8) between a paper guide 16 and an oblique roller 20, the paper presser 62 extending approximately from the location of the oblique roller 20 to a downstream end of the paper guide 16.

Figure 8:
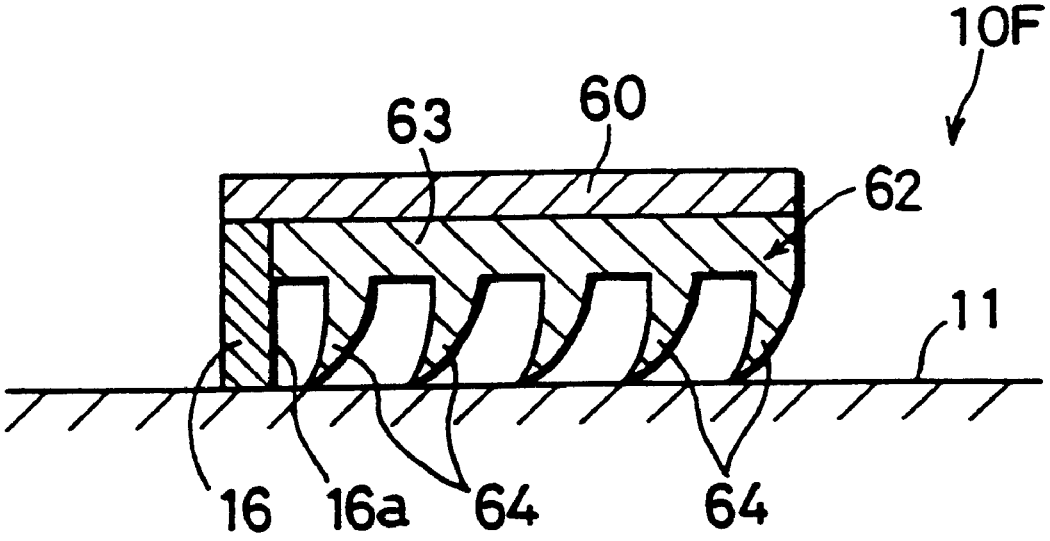
FIG. 8 is a sectional diagram taken along a line VIII—VIII of FIG. 7 showing the construction of a paper path of a copying machine incorporating a widthwise paper presser.

The paper presser 62 comes into contact with a surface of paper P being transferred and presses it onto the paper feeding plane 11. As shown in FIG. 8, the paper presser 62 is affixed to a bottom surface of a mounting plate 60 which is fixed to an upper end of the paper guide 16.

The entire body of the paper presser 62 is formed of an elastic material like soft rubber, for example. The paper presser 62 has a platelike base portion 63 and a plurality of narrow strip-like paper pressing pieces 64 which are arranged at regular intervals in the lateral direction and extend downward from the base portion 63 so that their lower ends come into contact with the paper feeding plane 11. The paper presser 62 has five paper pressing pieces 64 in the example shown in FIG. 8. The paper pressing pieces 64 need not necessarily be formed at equal intervals but may be arranged in any appropriate configuration.

As can be seen from FIG. 8, each of the paper pressing pieces 64 has a wedgelike structure in cross section having a pointed end. The lower ends of the paper pressing pieces 64 are curved toward a guiding surface 16*a* of the paper guide 16 so that the paper pressing pieces 64 tend to be deflected in a direction from the center line of the paper path 10F (from right to left in FIG. 8) but would not be easily deflected in the opposite direction.

Figure 9:
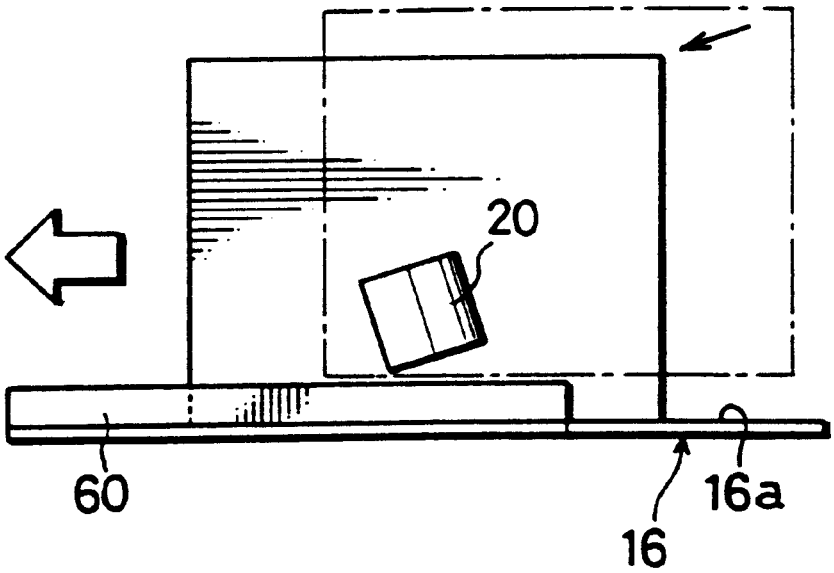
FIG. 9 is a schematic diagram illustrating how the lateral position of paper is corrected.

According to this construction, when the paper P acted upon by an obliquely pushing force by the oblique roller 20 is transferred obliquely toward the paper guide 16, a side edge of the paper P gradually comes into contact with the guiding surface 16*a* of the paper guide 16 from the forward part of the paper edge and eventually aligns with the guiding surface 16*a*, whereby the position of the paper P in the paper path 10F in its lateral direction is corrected as shown in FIG. 9.

Figure 10:
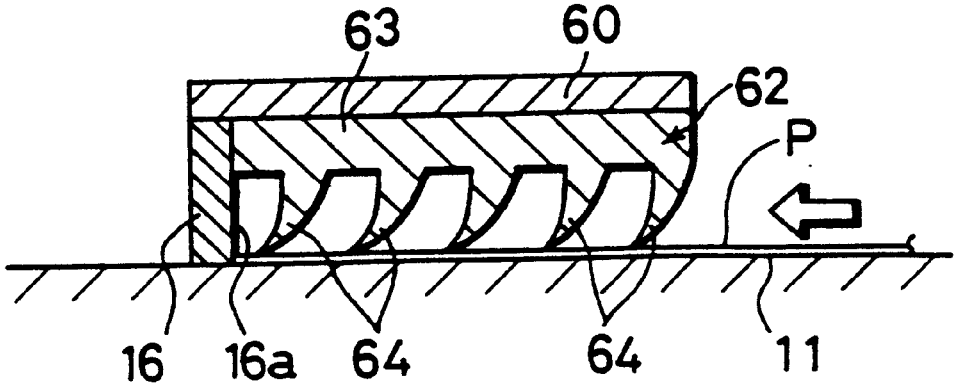
FIG. 10 is a diagram similar to FIG. 8 showing a status in which the paper has come into contact with a guiding surface of a paper guide.

Since the lower ends of the paper pressing pieces 64 of the paper presser 62 are in contact with the paper feeding plane 11 between the paper guide 16 and the oblique roller 20 and the paper pressing pieces 64 are formed into such a shape that they can easily be deflected toward the guiding surface 16*a* as stated above, the obliquely pushing force (shown by an arrow in FIG. 10) exerted by the oblique roller 20 causes the paper P to smoothly proceed toward the paper guide 16. As a consequence, the paper P is pressed by the paper pressing pieces 64 of the paper presser 62 as shown in FIG. 10. Thus, the paper P is least likely to be bent even when the oblique roller 20 continues to exert its obliquely pushing force on the paper P.

Since the paper pressing pieces 64 of the paper presser 62 are not easily deflected in the direction from the paper guide 16 toward the center line of the paper path 10F, the paper P is less likely to come apart from the paper guide 16 upon completion of paper position correction. It is therefore possible to correctly position the paper P in its lateral direction in a reliable manner in the above-described construction while preventing the bending of the paper P.

The aforementioned construction of the paper presser 62 provides such effects that it not only prevents the bending of the paper P but makes it less likely to come apart from the paper guide 16 after the paper position correcting operation. Moreover, the construction of this embodiment is advantageous in that the paper pressing pieces 64 effectively press the paper P onto the paper feeding plane 11 while keeping the frictional resistance between the paper pressing pieces 64 and the paper P at a minimum level, because the individual paper pressing pieces 64 have narrow strip-like form arranged parallel to the paper feeding direction. Thus, it is desirable to employ the aforementioned construction of the paper presser 62 in order to accomplish reliable paper position correction in the lateral direction of the paper P without causing paper feeding problems.

Although the present embodiment employs the paper presser 62 having a plurality of narrow strip-like paper pressing pieces 64 which are formed of rubber and arranged parallel to the paper feeding direction, each paper pressing piece 64 having a wedge-like pointed end deflected toward the guiding surface 16*a,* the paper pressing pieces 64 may be modified to a different structure or formed of other material than rubber as long as they can effectively prevent the bending of the paper P. In one example, the paper presser 62 may have, instead of the paper pressing pieces 64, flexible resin sheets extending downward in arc-shaped form which press the paper P onto the paper feeding plane 11. In another example, the paper presser 62 may be provided with a large number of rod-like pressing pieces projecting downward from the base portion 63 of the paper presser 62, instead of the paper pressing pieces 64.

Although the paper presser 62 is provided between the paper guide 16 and the oblique roller 20 to prevent the bending of the paper P in a region from the location of the oblique roller 20 to the downstream end of the paper guide 16 in this embodiment, the paper presser 62 may be provided in any region and location appropriate for preventing the bending of the paper P in a reliable manner depending on a specific arrangement of the oblique roller 20 and the paper guide 16, properties of the paper P to be handled, the structure of the paper presser 62, and so forth.

A seventh embodiment of the invention is now described with reference to FIGS. 11 and 12.

Figure 11:
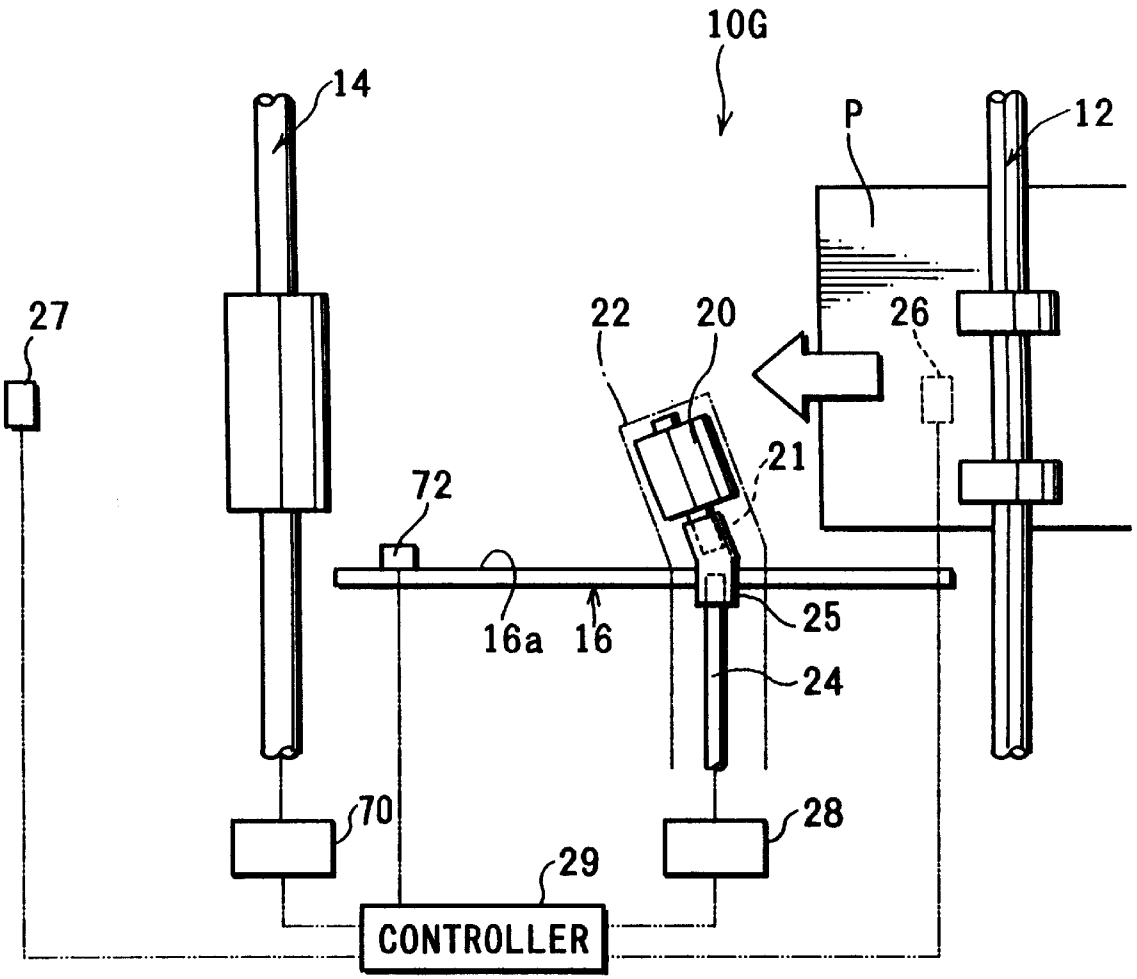
FIG. 11 is a plan view showing a paper path of a copying machine incorporating a lateral paper position correcting mechanism according to a seventh embodiment of the invention.
Figure 12:
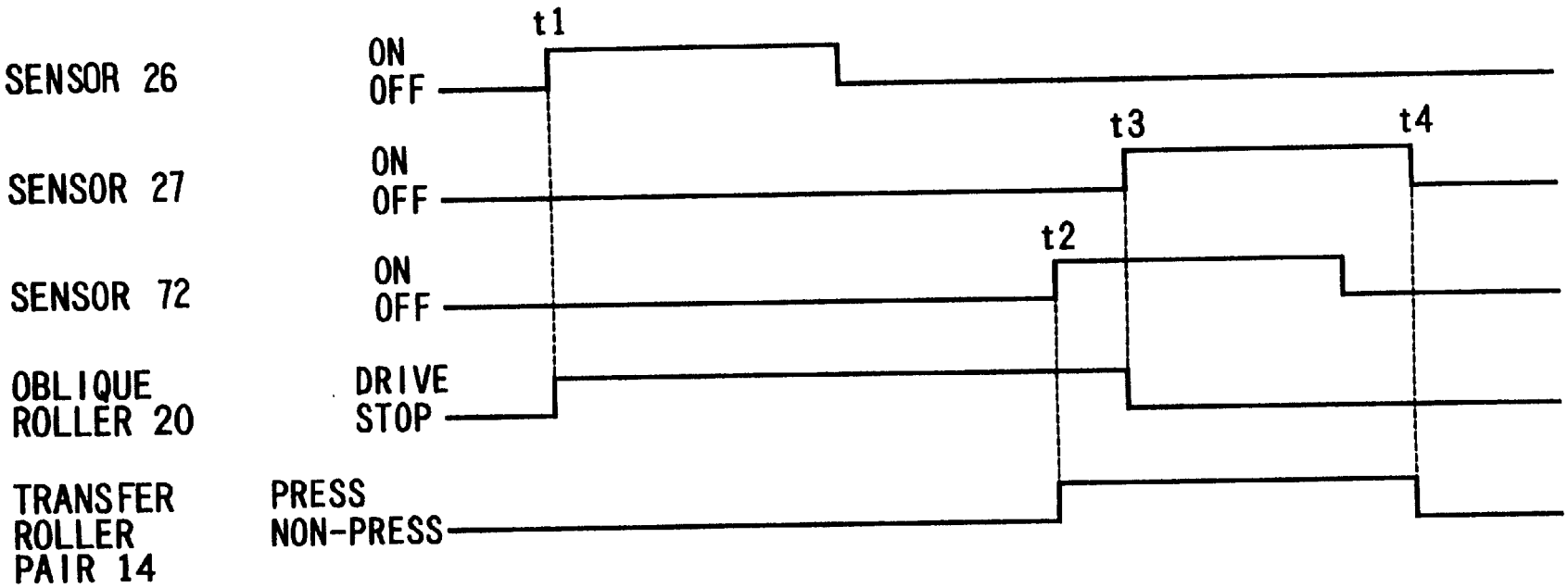
FIG. 12 is a timing chart depicting paper position correcting operation.

FIG. 11 shows a paper path 10G incorporating a lateral paper position correcting mechanism of the seventh embodiment. The following discussion of this embodiment focuses on differences from the paper path 10A of the first embodiment, in which elements identical to or equivalent to those included in the paper path 10A are designated by the same reference numerals.

The paper path 10G of this embodiment is provided with a pair of upstream transfer rollers 12 and a pair of downstream transfer rollers 14. Both transfer rollers 14 on the downstream side are made switchable between a pressing state (active state) in which the transfer rollers 14 are pressed to each other from top and bottom sides of paper P and a non-pressing state (idle state) in which the transfer rollers 14 are set apart from each other. Although not specifically illustrated, the transfer rollers 14 are switched between these two states by a drive mechanism 70 incorporating a solenoid as a prime mover. The transfer rollers 14 nip the paper P and transfer it when they are in the pressing state, while the transfer rollers 14 are separated from each other creating a gap between them to allow the paper P to proceed freely between them.

The transfer roller pair 14 is located at a position where it can nip the leading edge of the paper P when the paper position correcting operation has been completed, for example. Such location of the transfer roller pair 14 is established based on results of experiments in which many sheets of paper P are successively fed through the paper path 10G and the position of the paper P at the end of the paper position correcting operation is determined.

Mounted on a guiding surface 16*a* of a paper guide 16, slightly upstream of the transfer rollers 14, is a paper sensor 72 formed of a reflection-type sensing device similar to the earlier-mentioned sensors 26, 27. When the paper P is detected by this paper sensor 72, it is judged that the position of the paper P in its lateral direction has been corrected. More particularly, the paper P comes into contact with the paper guide 16 when the position of the paper P in the paper path 10G in its lateral direction has been corrected. The completion of the paper position correcting operation is detected when the sensor 72 mounted on the guiding surface 16*a* detects the paper P.

The aforementioned drive mechanism 70 and the sensor 72 are both connected to a controller 29 which switches the transfer roller pair 14 between the pressing state and the non-pressing state based on paper sensing operation of the sensor 72.

The paper position correcting operation performed in the paper path 10G thus constructed is described below with reference to a timing chart of FIG. 12.

In the paper path 10G, the paper P is fed from the upstream side of the transfer roller pair 12 in a direction shown by an arrow in FIG. 11. The transfer roller pair 14 is in its non-pressing state and an oblique roller 20 is at rest in the beginning. It is to be noted that the individual transfer rollers 12 and 14 are rotated continuously while the paper P is being transferred.

When the paper P passes under the transfer roller pair 12 and the leading edge of the paper P is detected by the sensor 26 at time t1, an electromagnetic clutch 28 is engaged and a rotating force of a driving motor is transmitted to the oblique roller 20.

As the paper P is further advanced and its leading edge reaches the oblique roller 20, the paper P is transferred by both the transfer roller pair 12 and the oblique roller 20 and an obliquely pushing force of the oblique roller 20 is exerted on the paper P, causing it to be transferred obliquely toward the paper guide 16. As a result, a side edge of the paper P comes into contact with the guiding surface 16*a* of the paper guide 16 and eventually aligns with the guiding surface 16*a,* whereby the position of the paper P in the paper path 10G in its lateral direction is corrected.

When the paper position correcting operation is completed, or when the paper P is detected by the sensor 72 at time t2, the transfer roller pair 14 is switched from the non-pressing state to the pressing state and the leading edge of the paper P is nipped by the transfer roller pair 14. Subsequently, the paper P is transferred downstream by the transfer roller pair 14 and the oblique roller 20. If the paper position correcting operation has not been completed when the leading edge of the paper P reaches the transfer roller pair 14, the leading edge of the paper P passes between the transfer rollers 14 and the oblique roller 20 continues to feed the paper P obliquely toward the guiding surface 16*a*.

The paper P is advanced in this manner, and when its leading edge is detected by the sensor 27 at time t3, the oblique roller 20 is stopped. The paper P is further advanced, and when it completely passes the sensor 27 at time t4, the transfer roller pair 14 is switched to its non-pressing state.

According to the construction of this embodiment, the oblique roller 20 is driven until the paper P completely passes under the oblique roller 20 regardless of whether the paper position correcting operation has been completed in a manner similar to the first to sixth embodiments. Therefore, the oblique roller 20 continuously exerts the obliquely pushing force on the paper P so that the paper P is transferred with its side edge held in full contact with the guiding surface 16*a,* that is, the lateral position of the paper P after the paper position correcting operation is maintained as it is transferred downstream.

Furthermore, the transfer roller pair 14 is switched to its pressing state upon completion of the paper position correcting operation and thereby exerts a feeding force on paper P. Thus, the paper P is less likely to be bent even when the oblique roller 20 continues to be driven after the paper position correcting operation.

More particularly, the paper P is acted upon by a resultant, or a combination, of the paper feeding force exerted by the transfer roller pair 14 and the obliquely pushing force exerted by the oblique roller 20 after paper position correction, the resultant force being more parallel to the paper feeding direction. The obliquely pushing force acting on the paper P is therefore lessened upon completion of the paper position correcting operation so that it becomes possible to effectively prevent the bending of the paper P while maintaining the corrected position of the paper P in a reliable manner by driving the oblique roller 20 even after the paper position correcting operation.

Moreover, since the paper P is transferred by both the transfer roller pair 14 and the oblique roller 20, it is possible to exert a greater feeding force on the paper P, especially on a more forward portion of the paper P, compared to the conventional mechanism in which the oblique roller is withdrawn to its retracted position immediately after the paper position correcting operation and the paper is then advanced only by a pair of transfer rollers located upstream of the oblique roller. Thus, the lateral paper position correcting mechanism of this embodiment ensures smooth paper feeding after the paper position correcting operation without causing the forward portion of the paper P to jam or otherwise become stuck in the paper path 10G.

Although the transfer roller pair 14 is located at a position where it can nip the leading edge of the paper P when the paper position correcting operation has been completed, it is not necessarily essential to nip the leading edge of the paper P. As an alternative, the transfer roller pair 14 may be located at any convenient position where it can exert a feeding force on the paper P after the paper position correcting operation while the oblique roller 20 is being rotated. It is however preferable that the transfer roller pair 14 be located where it can nip the leading edge of the paper P immediately after the paper position correcting operation as shown in the construction of this embodiment, because the forward portion of the paper P is likely to jam or otherwise become stuck in the paper path 10G due to a frictional resistance which occurs between the paper P and the paper guide 16 after the paper position correcting operation. In the construction of this embodiment, it is possible to smoothly transfer the paper P regardless of the frictional resistance exerted by the paper guide 16 even when the paper path 10G slopes upward.

Although the single sensor 72 is used to detect the completion of the paper position correcting operation in this embodiment, there may be provided two sensors separated by a specified distance along the guiding surface 16*a* so that the completion of the paper position correcting operation is sensed based on detection of the paper P by these two sensors. This alternative arrangement is advantageous in that the completion of the paper position correcting operation can be detected more accurately as it becomes possible to sense that the paper P has completely come into contact with the guiding surface 16*a* all along a side edge of the paper P from its leading edge to trailing edge by detecting appropriate two points on the side edge of the paper P.

Although the foregoing discussion of the first to seventh embodiments has described the lateral paper position correcting mechanisms incorporated in a copying machine, the mechanisms of the invention can also be implemented in other image forming apparatus such as a printer or a facsimile machine.

What is claimed is:

1. A lateral paper position correcting mechanism comprising:

a paper aligning member mounted in a paper path parallel to a paper feeding direction;

an oblique roller for moving paper at an oblique angle to the paper feeding direction to cause the paper to come into contact with said paper aligning member to correct the position of the paper in said paper path in its lateral direction;

a paper sensor capable of detecting the paper at least while the paper is passing by said oblique roller;

a driving controller which drives said oblique roller while the paper is being detected by said paper sensor; and preventing means for preventing the paper from bending while it is being transferred, said preventing means comprising a contact surface on said paper aligning member which is contacted by said paper, said contact surface comprising a fluoroplastic material.

2. A lateral paper position correcting mechanism according to claim 1, wherein said fluoroplastic material is a coating on said paper aligning member.

3. A lateral sheet position correcting mechanism for correcting positioning of a sheet moving in a feeding direction comprising:

a sheet aligning unit comprising a pair of pulleys and an endless belt mounted on said pulleys, said endless belt having a linear path portion extending between said pair of pulleys and disposed parallel to said feeding direction;

an oblique roller for moving a sheet at an oblique angle relative to said feeding direction to thereby impart to the sheet a forward force component for moving said sheet in said feeding direction and a lateral force component for urging said sheet in a lateral direction perpendicular to said feeding direction and toward said linear path portion of said endless belt;

a controller for driving said oblique rollers as said sheet passes said oblique roller;

said lateral force component of said driven oblique roller moving said sheet in said lateral direction into contact with said linear path portion of said belt and subsequently continuing to urge said sheet into contact with said linear path portion of said belt until said sheet passes said oblique roller; and a drive unit for driving one of said pulleys to rotate said endless belt in synchronism with the drive of said oblique roller by said controller to thereby prevent bending of the sheet as the sheet is urged into contact with said linear path portion of said endless belt.

4. A lateral sheet position correcting mechanism comprising:

a paper aligning member mounted in a paper path parallel to a sheet feeding direction;

an oblique roller for moving paper at an oblique angle to the paper feeding direction to cause the paper to come into contact with said paper aligning member to correct the position of the paper in said paper path in its lateral direction;

a paper sensor capable of detecting the paper at least while the paper is passing by said oblique roller;

a driving controller which drives said oblique roller while the paper is being detected by said paper sensor; and a preventing means for preventing the paper from bending while the paper is being transferred, said preventing means including a paper presser arranged in said paper path for pressing the paper being transferred onto a paper feeding plane, said paper presser being constructed such that the paper can easily move a direction toward said paper aligning member but can easily move in the opposite direction.

5. A lateral paper position correcting mechanism according to claim 4, wherein said paper presser has a plurality of narrow strip-like paper pressing pieces each of which extends parallel to the paper feeding direction, and each of the paper pressing pieces is made of an elastic material forming a gradually narrowed cross section towards its free end and deflected toward said paper aligning member, extends downward and comes into contact with the paper.

6. A lateral sheet position correcting mechanism for correcting positioning of a sheet moving in a feeding direction comprising:

a sheet aligning unit extending in a direction parallel to said feeding direction;

an oblique roller for moving a sheet at an oblique angle relative to said feeding direction to thereby impart to the sheet a forward force component for moving said sheet in said feeding direction and a lateral force component for urging said sheet in a lateral direction perpendicular to said feeding direction and toward said sheet aligning unit; p1 a controller for driving said oblique roller as said sheet passes said oblique roller;

said lateral force component of said driven oblique roller moving said sheet in said lateral direction into contact with said sheet aligning unit and subsequently continuing to urge said sheet into contact with said sheet aligning unit until said sheet passes said oblique roller; and a preventing structure on said sheet aligning unit for preventing bending of the sheet as the sheet is urged into contract with the sheet alignment unit, said preventing structure comprising a low friction material selected from the group consisting of fluoroplastic and polyethylene.

7. A lateral sheet position correcting mechanism for correcting positioning of a sheet moving in a feeding direction comprising:

a sheet aligning unit extending in a direction parallel to said feeding direction;

an oblique roller for moving a sheet at an oblique angle relative to said feeding direction to thereby impart to the sheet a forward force component for moving said sheet in said feeding direction and a lateral force component for urging said sheet in a lateral direction perpendicular to said feeding direction and toward said sheet aligning unit;

a controller for driving said oblique roller as said sheet passes said oblique roller;

said lateral force component of said driven oblique roller moving said sheet in said lateral direction into contact with said sheet aligning unit and subsequently continuing to urge said sheet into contact with said sheet aligning unit until said sheet passes said oblique roller; and a preventing structure on said sheet aligning unit for preventing bending of the sheet as the sheet is urged into contract with the sheet alignment unit, said preventing structure comprising a flexible material.

8. A lateral sheet position correcting mechanism according to claim 7 wherein said flexible material comprises a plastic material.

9. A lateral sheet position correcting mechanism according to claim 7 wherein said sheet flexible material comprises a flexible resin.

10. A lateral sheet position correcting mechanism according to claim 7 wherein said sheet flexible material comprises rubber.

11. A lateral sheet position correcting mechanism for correcting positioning of a sheet moving in a feeding direction comprising:

a sheet aligning unit extending in a direction parallel to said feeding direction;

an oblique roller for moving a sheet at an oblique angle relative to said feeding direction to thereby impart to the sheet a forward force component for moving said sheet in said feeding direction and a lateral force component for urging said sheet in a lateral direction perpendicular to said feeding direction and toward said sheet aligning unit;

a controller unit for driving said oblique roller as said sheet passes said oblique roller;

said lateral force component of said driven oblique roller moving said sheet in said lateral direction into contact with said sheet aligning unit and subsequently continuing to urge said sheet into contact with said sheet aligning unit until said sheet passes said oblique roller; and a preventing structure on said sheet aligning unit for preventing bending of the sheet as the sheet is urged into contract with the sheet alignment unit, said sheet aligning unit comprising an alignment member and said preventing structure comprising a coating of low friction material on said alignment member.

12. A lateral paper position correcting mechanism according to claim 11, wherein said preventing structure includes:

an end-of-correction sensor which senses that the position of the sheet has been corrected;

a pair of transfer rollers provided downstream of said oblique roller, said transfer rollers being switchable between an active state in which said transfer rollers can transfer the sheet and an idle state; and a switching controller which keeps said transfer rollers in the idle state when the sheet is being transferred and switches said transfer rollers to the active state when said end-of-correction sensor has detected completion of sheet position correction.

13. A lateral paper position correcting mechanism according to claim 12, wherein said transfer rollers are so arranged as to nip the leading edge of sheet when said transfer rollers have been switched from the idle state to the active state.

14. A lateral sheet position correcting mechanism for correcting positioning of a sheet moving in a feeding direction and wherein the sheet has a sheet length measured in the feed direction, the mechanism comprising:

feed rollers for feeding a sheet in said feeding direction;

a sheet aligning unit extending in a direction parallel to said feeding direction;

an oblique roller for moving a sheet at an oblique angle relative to said feeding direction to thereby impart to the sheet a forward force component for moving said sheet in said feeding direction and a lateral force component for urging said sheet in a lateral direction perpendicular to said feeding direction and toward said sheet aligning unit;

a sensor at a location upstream of said oblique roller for providing a signal upon sensing the presence of a sheet at said location;

a controller for initiating driving of said oblique roller upon receiving said signal and for continuing to drive said oblique roller at least until the sheet has passed said oblique roller;

said feed rollers and said oblique roller being spaced from one another in said feeding direction a distance which is less than said sheet length such that when said controller initiates driving of said oblique roller, said feed roller continues to feed the sheet in the feeding direction and the sheet is thereby moved in said feeding direction by the feed rollers and by the forward force component of the oblique roller while simultaneously being urged in the lateral direction toward said sheet aligning unit by the lateral force component of the oblique roller;

said lateral force component of said oblique roller moving said sheet in said lateral direction into contact with said sheet aligning unit and subsequently continuing to urge said sheet into contact with said sheet alignment unit prior to the passing of the sheet past said oblique roller;

said sheet aligning unit including a preventing structure for preventing bending of the sheet as the sheet is urged into contract with the sheet alignment unit.

15. A lateral sheet position correcting mechanism according to claim 14 wherein said sensor is designated a first sensor, said signal is designated a first signal and said location is designated a first location, further comprising a second sensor at a second location downstream of said oblique roller for providing a second signal upon sensing the presence of a sheet at said second location, advancing rollers for advancing said sheet in said feeding direction, said controller terminating driving of said oblique roller upon receiving said second signal, said advancing rollers continuing to advance said sheet in said feeding direction after driving of said oblique roller has been terminated by said controller.

16. A lateral sheet position correcting mechanism according to claim 15 wherein said advancing rollers and said oblique roller are spaced from one another in said feeding direction a distance which is less than said sheet length such that the sheet is thereby moved in said feeding direction by the advancing rollers and by the forward force component of the oblique roller while simultaneously being urged in the lateral direction toward said sheet aligning unit by said lateral force component of the oblique roller.

17. A lateral sheet position correcting mechanism according to claim 15 wherein said advancing rollers are disposed downstream of said oblique roller, said second sensor is disposed downstream of said advancing rollers and said first sensor is disposed downstream of said feed rollers.

18. A lateral sheet position correcting mechanism according to claim 14 further comprising a transfer roller switchable between an active state in which the transfer roller is operable to advance the sheet in the feeding direction and an inactive state in which the transfer roller is inoperable to advance the sheet;

an end-of-correction sensing unit which has a sensed state when said sheet contacts said sheet aligning unit and an unsensed state when said sheet is displaced from contact with said sheet aligning unit, said sensing unit when in said sensed state being operable to effect activation of said transfer roller from said inactive state to said active state;

said transfer roller and said oblique roller being spaced from one another in said feeding direction a distance which is less than said sheet length to thereby provide one operable state in which said sensing unit is in said sensed state and said transfer roller is in said activated state such that the sheet is advanced in said feeding direction by said activated transfer roller and also by the forward force component of the oblique roller and another operable state in which said sensing unit is in said unsensed state and said transfer roller is in said inactive state such that the sheet is advanced in the feeding direction past the inactive transfer roller by the forward force component of the oblique roller while simultaneously being moved laterally toward said sheet aligning unit by the lateral force component of said oblique roller.

19. A lateral sheet position correcting mechanism according to claim 14 wherein said oblique roller comprises a roller element and a roller shaft, said roller element and said roller shaft having a common axis disposed at an acute angle relative to said feed direction, a driven shaft having an axis perpendicular to said feeding direction, and a universal joint between said driven shaft and said roller shaft.

20. A lateral sheet position correcting mechanism according to claim 14 wherein said sheet aligning unit comprises an alignment member and said preventing structure comprises a coating of low friction material on said alignment member.

21. A lateral sheet position correcting mechanism according to claim 14 wherein said sheet aligning unit comprises a fluoroplastic material.

* * * * *